US010928043B2

(12) United States Patent
McCane et al.

(10) Patent No.: US 10,928,043 B2
(45) Date of Patent: Feb. 23, 2021

(54) ROTATABLE LIGHT FIXTURE

(71) Applicant: ABL IP Holding LLC, Atlanta, GA (US)

(72) Inventors: Stephen Barry McCane, McDonough, GA (US); Forrest Starnes McCanless, Oxford, GA (US); Albert Tran, Norcross, GA (US); John Thomas Mayfield, III, Grayson, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/535,319

(22) Filed: Aug. 8, 2019

(65) Prior Publication Data

US 2020/0049333 A1 Feb. 13, 2020

Related U.S. Application Data

(60) Provisional application No. 62/715,907, filed on Aug. 8, 2018, provisional application No. 62/721,731, filed on Aug. 23, 2018.

(51) Int. Cl.

| | |
|---|---|
| ***F21V 21/14*** | (2006.01) |
| ***F21V 23/00*** | (2015.01) |
| ***F21S 8/06*** | (2006.01) |
| ***F21V 23/06*** | (2006.01) |
| *F21Y 103/10* | (2016.01) |
| *F21Y 115/10* | (2016.01) |

(52) U.S. Cl.

CPC ..... *F21V 21/14* (2013.01); *F21S 8/06* (2013.01); *F21V 23/003* (2013.01); *F21V 23/06* (2013.01); *F21Y 2103/10* (2016.08); *F21Y 2115/10* (2016.08)

(58) Field of Classification Search

CPC ..... F21V 21/14; F21V 23/003; F21V 23/06; F21V 15/015; F21S 8/06; F21S 8/061; F21S 4/28; F21Y 2103/10; F21Y 2115/10

See application file for complete search history.

(56) References Cited

U.S. PATENT DOCUMENTS

| | | | | |
|---|---|---|---|---|
| 5,909,955 | A * | 6/1999 | Roorda | F21S 8/04 362/368 |
| 7,553,051 | B2 * | 6/2009 | Brass | F21S 4/20 362/373 |
| 2007/0285921 | A1 * | 12/2007 | Zulim | F21S 2/00 362/240 |
| 2011/0255267 | A1 * | 10/2011 | Fredricks | F21V 33/0028 362/101 |
| 2015/0198298 | A1 * | 7/2015 | Scarlata | F21S 9/00 362/184 |
| 2017/0002990 | A1 * | 1/2017 | O'Brien | F21S 8/061 |
| 2018/0306395 | A1 * | 10/2018 | Conrad | F21K 9/61 |
| 2019/0264897 | A1 * | 8/2019 | Van Winkle | F21V 21/096 |

* cited by examiner

*Primary Examiner* — Kevin Quarterman
(74) *Attorney, Agent, or Firm* — Kilpatrick Townsend & Stockton LLP

(57) ABSTRACT

A light fixture includes a main body, at least a portion of which is generally cylindrical, the main body having an open side, and one or more light sources disposed within the main body. The light fixture further includes one or more mounting rings configured to substantially encircle the main body and configured for mounting the light fixture. A diffuser may be provided, covering the open side of the main body and enclosing the one or more light sources within the light fixture.

21 Claims, 16 Drawing Sheets

ROTATABLE LIGHT FIXTURE

CROSS REFERENCE TO RELATED APPLICATIONS

This application claims the benefit of U.S. Provisional Patent Application No. 62/715,907 filed Aug. 8, 2018 and titled "Rotatable Light Fixture", and of U.S. Provisional Patent Application No. 62/721,731 filed Aug. 23, 2018 and titled "Rotatable Light Fixture", the entire disclosures of which are hereby incorporated by reference herein for all purposes.

BACKGROUND OF THE INVENTION

Merchandise in large retail stores such as home improvement stores is often displayed on tall and deep racks, in spaces with very high ceilings. Accordingly the merchandise may be shaded from overhead light in the spaces, and therefore difficult for customers to see clearly.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

According to one aspect, a light fixture comprises a main body, at least a portion of the main body being generally cylindrical, and the main body having an open side. The light fixture also includes one or more light sources disposed within the main body, and one or more mounting rings configured to substantially encircle the generally cylindrical portion of main body and configured for mounting the light fixture. In some embodiments, the main body is generally cylindrical along its entire length. In some embodiments, the light fixture further comprises a diffuser covering the open side of the main body and enclosing the one or more light sources within the light fixture. In some embodiments, the main body can be positioned at any angular orientation within the one or more mounting rings. In some embodiments, the light fixture further comprises a screw disposed through one of the mounting rings and tightenable against the main body to lock the main body at a specific rotation angle. In some embodiments, at least one of the one or more mounting rings forms a clamp tightenable against the main body to lock the main body at a specific rotation angle. In some embodiments, at least one of the one or more mounting rings maintains friction with the main body via spring tension. In some embodiments, the light fixture further comprises a driver circuit disposed within the main body. In some embodiments, the one or more light sources comprise a plurality of light emitting diodes (LEDs), and wherein the driver circuit converts alternating current (AC) line voltage to a direct current (DC) voltage for driving the LEDs. In some embodiments, the light fixture further comprises a respective connector at each end of the main body, the connectors configured to enable connecting additional like light fixtures in daisy chain fashion. In some embodiments, the mounting rings comprise formed wire loops. In some embodiments, the mounting rings comprise formed sheet metal loops. In some embodiments, the light fixture further comprises a rotation stop, wherein the rotation stop engages a groove in the main body. In some embodiments, the light fixture further comprises an angle bracket and a clip configured for mounting the light fixture to a flat surface. In some embodiments, the light fixture further comprises a hanger configured for suspending the light fixture from a ceiling. In some embodiments, the light fixture further comprises an end cap and a rotatable insert in the end cap, the rotatable insert including rotation stops that limit the range of rotation of the light fixture.

According to another aspect, a merchandise bay comprises a shelf, a front crossbeam supporting a front edge of the shelf, and a light fixture mounted below the shelf and behind the front crossbeam. The light fixture further comprises a main body having an open side, one or more light sources disposed within the main body, and one or more mounting rings configured to substantially encircle the main body and configured for mounting the light fixture. In some embodiments, the merchandise bay further comprises a diffuser covering the open side of the main body and enclosing the one or more light sources within the light fixture. In some embodiments, wherein the main body of the light fixture comprises at least a portion that is generally cylindrical, and the mounting rings substantially encircle the main body in the generally cylindrical portion. In some embodiments, wherein the light fixture can be positioned at any angular orientation within the one or more mounting rings. In some embodiments, the shelf is a first shelf, the front crossbeam is a first front crossbeam, and the light fixture is a first light fixture, and the merchandise bay further comprises a second shelf, a second front crossbeam supporting a front edge of the second shelf, and a second light fixture substantially identical to the first light fixture, the second light fixture mounted below the second shelf and behind the second front crossbeam.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
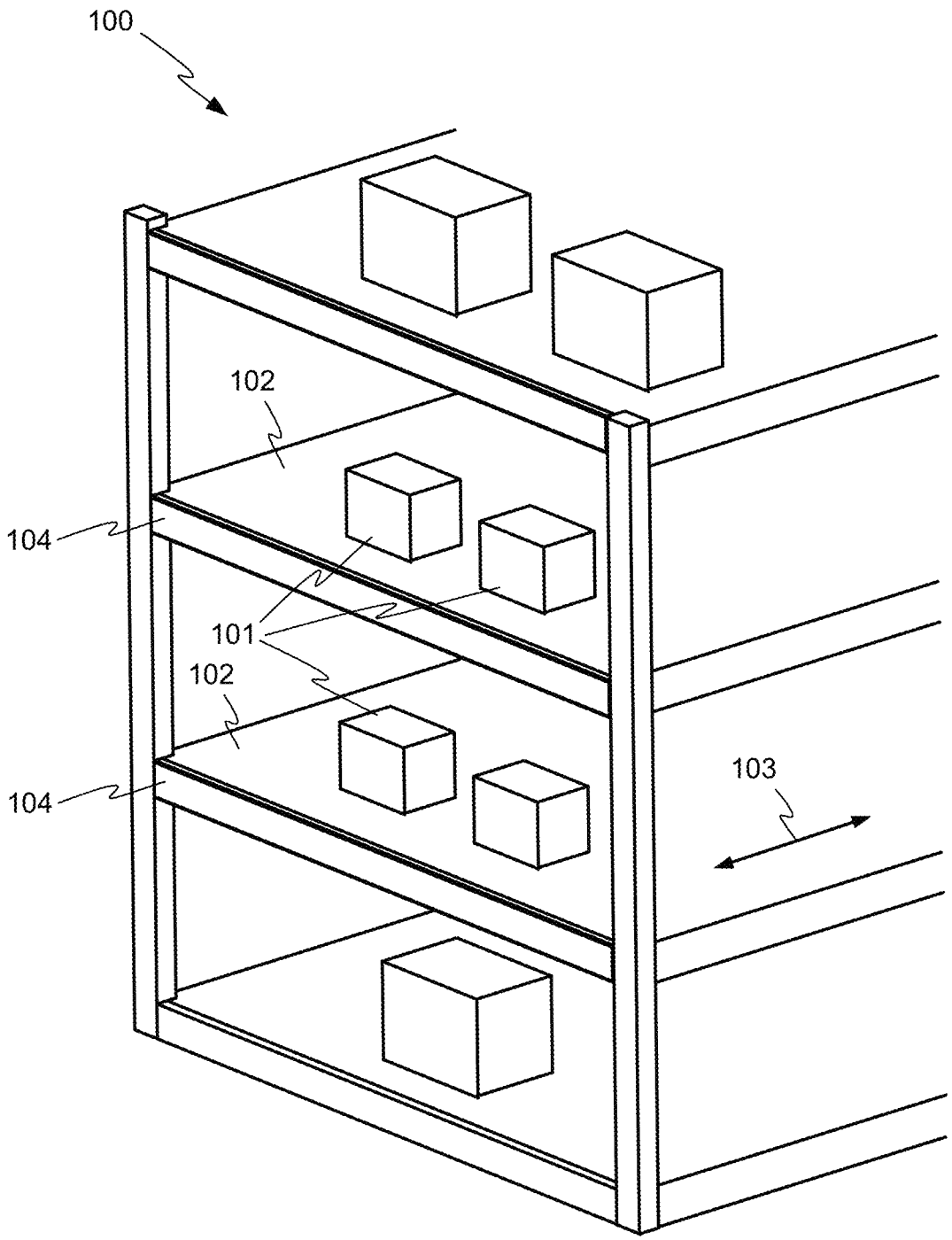
FIG. 1 shows a front upper oblique view of a merchandise bay, in accordance with embodiments of the invention.

FIG. 1 depicts a simplified view of a merchandise bay 100 as may be found in a home improvement or other retail store. Merchandise 101 is displayed on shelves 102, which may be deep in a front-to-back direction 103. Each of the shelves 102 may be supported in part by a front crossbeam 104. Bays such as the bay 100 are often placed in spaces having very high ceilings, and are lit from above, by overhead lights. The merchandise 101 on the lower shelves 102 may be shadowed by the shelves 102 above, and thus difficult to see.

Embodiments of the invention may provide flexible, easily mounted, unobtrusive lighting for the merchandise 101 on shelves such as the shelves 102.

Figure 2:
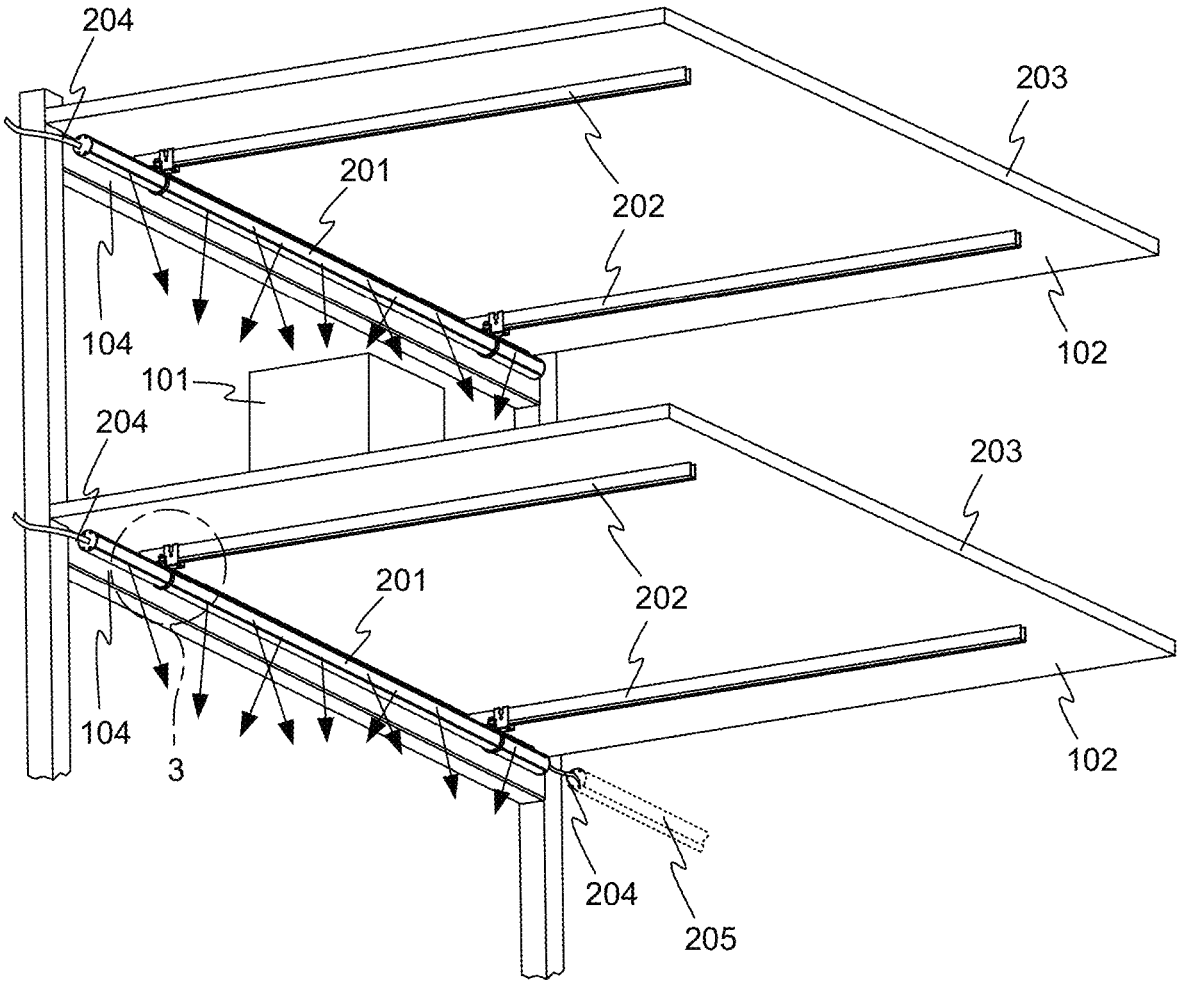
FIG. 2 shows a lower rear oblique view of a portion of the merchandise bay of FIG. 1, including a light fixture in accordance with embodiments of the invention.

FIG. 2 shows a lower rear oblique view of a portion of the merchandise bay 100 of FIG. 1. One or more light fixtures 201 are provided, and may preferably be mounted below the shelves 102 and behind the front crossbeams 104, so that the light fixtures 201 may not be visible to customers in front of the bay 100. Each of the light fixtures 201 may preferably direct light generally downward and toward the rear 203 of one of the shelves 102, to illuminate the merchandise 101 on the shelves 102.

Each of the shelves 102 may also be supported in part by front-to-back beams 202, and the light fixtures 201 may conveniently be hung from the beams 202, as is discussed in more detail below. The light fixtures can preferably be retrofitable to existing shelving.

Each of the light fixtures may receive power from a cable 204 that enters one end of the light fixture 201. Light fixtures 201 in adjacent bays may be daisy-chained together, as shown at 205, so that shelves in some or all of an aisle can be lit from a single power source.

Figure 3:
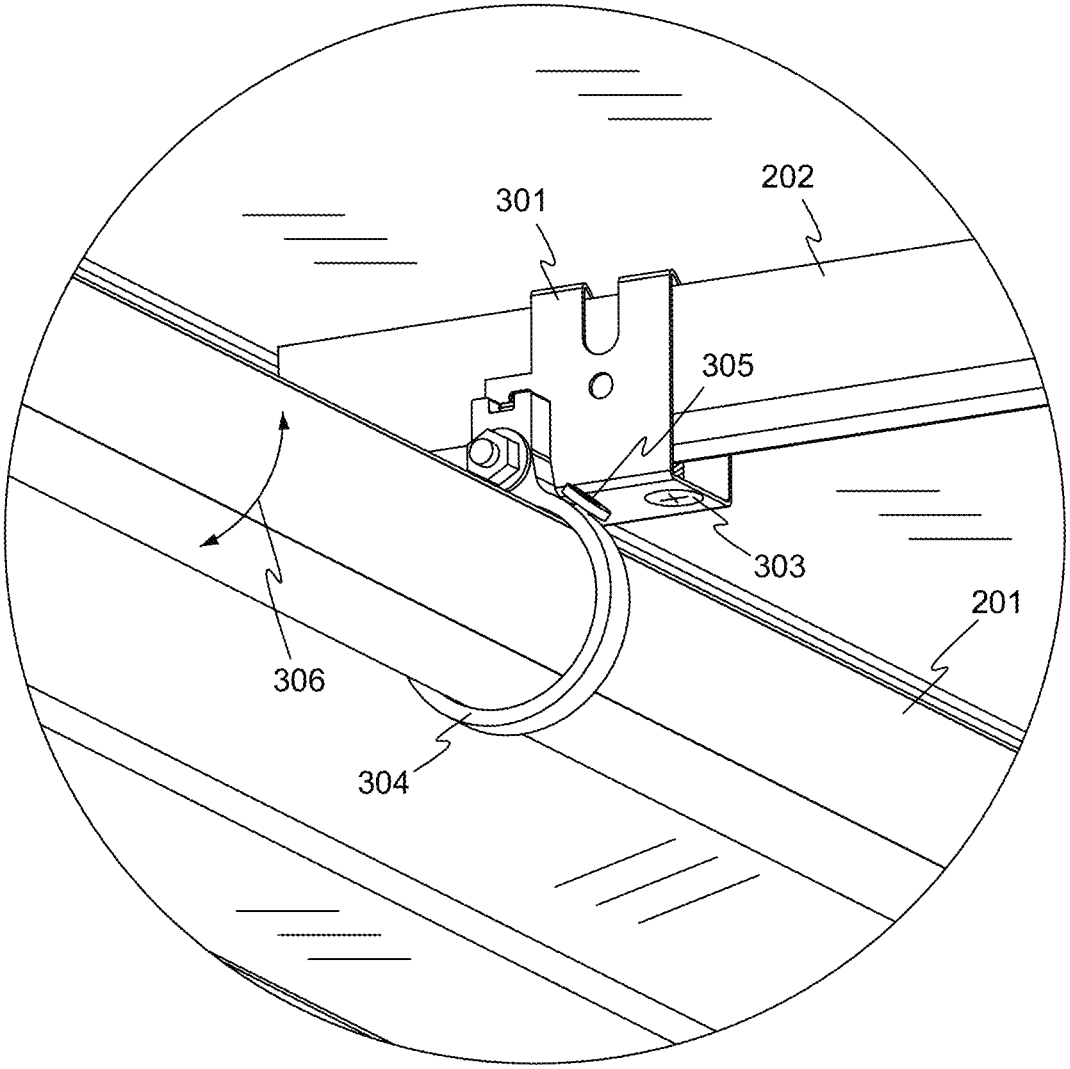
FIG. 3 is an enlarged view of a portion of FIG. 2.
Figure 4:
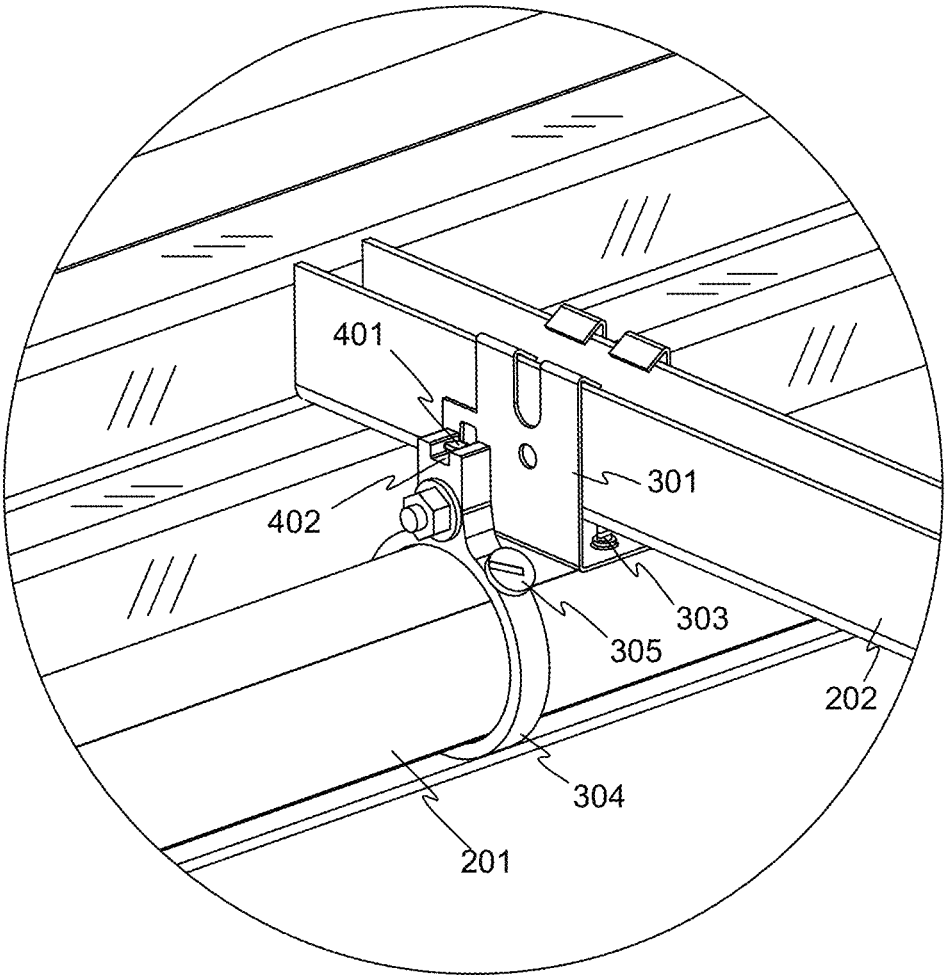
FIG. 4 shows an upper oblique view of the region shown in FIG. 3.

FIG. 3 is an enlarged view of a portion of FIG. 2, and shows details of the mounting of the light fixture 201 into the bay in one example embodiment. FIG. 4 shows an upper oblique view of the region illustrated in FIG. 3 (with the shelf above removed). Referring to FIGS. 3 and 4, the light fixture 201 is mounted to the beam 202 using a clip 301 that couples to the beam 202. A screw 303 or another kind of fastening device may be provided for securing the clip 301 to the beam 202, to prevent the light fixture 201 from being accidentally dislodged. In other embodiments, a clip such as the clip 301 may snap tightly to the beam 202, or may be secured in another way.

A mounting ring 304 encircles or substantially encircles the light fixture 201, and is bolted or otherwise attached to the clip 301. Thus, the light fixture 201 is suspended from the beam 202. The light fixture 201 is generally cylindrical, and in some embodiments can be rotated within the mounting ring 304 to any desired orientation, as shown at 306. Because any orientation is achievable, the light fixture 201 may be considered to be infinitely rotatable. A thumbscrew 305 or other device can be tightened against the light fixture 201 to lock the light fixture 201 at the desired rotation angle. In other embodiments, the light fixture 201 may be held at the desired rotation angle by another suitable technique. For example, the mounting ring 304 may be in the form of a split ring clamp that can clamp the light fixture 201 in position. In other embodiments, the light fixture 201 may be held at the desired rotation angle by friction with the mounting ring 304 or another part. The mounting ring 304 may be made of any suitable material, for example aluminum, steel, a polymer such as polycarbonate, or another suitable material.

A tab 401 may be provided, extending from the clip 301 and nesting in a recess 402 in the mounting ring 304, preventing rotation of the mounting ring 304 with respect to the clip 301.

Figure 5:
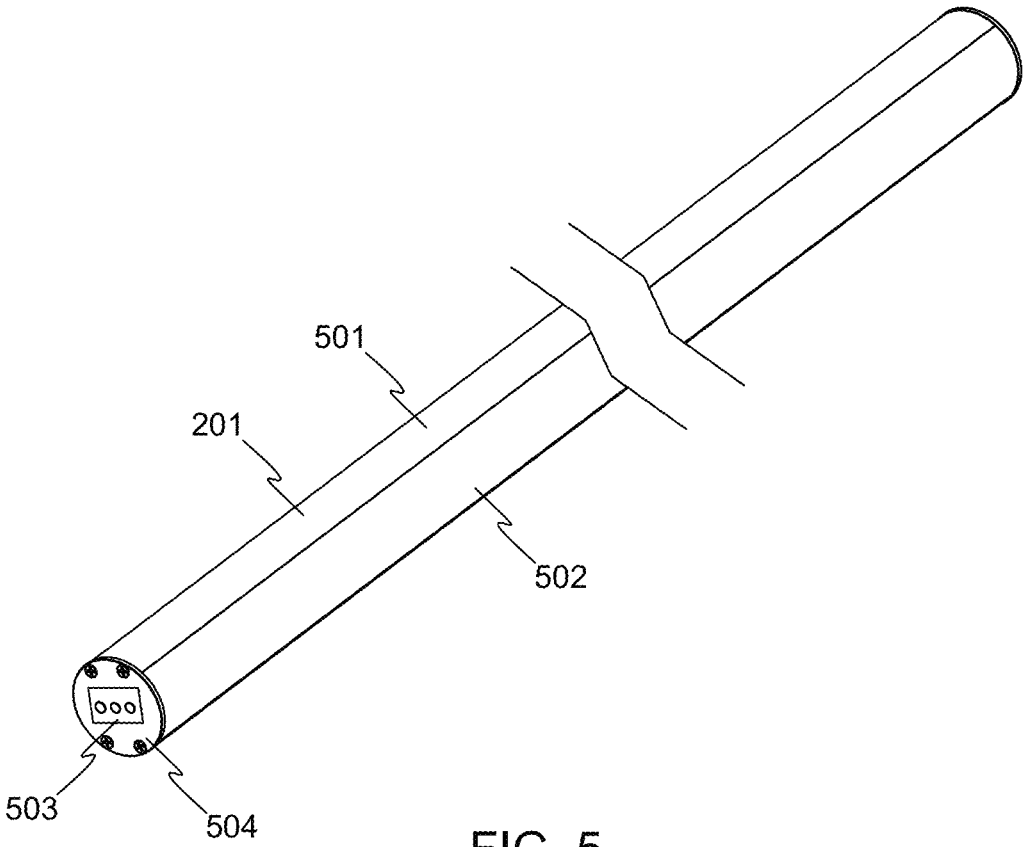
FIG. 5 illustrates a shortened view of the light fixture of FIG. 2.

FIG. 5 illustrates a shortened view of the light fixture 201, showing additional details. The light fixture 201 may be generally cylindrical, having a main body 501 and diffuser 502. Light sources within the light fixture 201 emit light through the diffuser 502, as is described in more detail below. In other embodiments, no diffuser may be present. A connector 503 may be present on each end cap 504 of the light fixture 201, to receive power to the light fixture 201 and to permit daisy chaining of similar light fixtures 201 together as described above. The connector 503 may be any suitable type of connector, having pins or sockets that are complementary to a connector on a cable such as the cable 204 that connects adjacent fixtures together. The power transferred from one light fixture 201 to the next may be of any suitable character, for example direct current (DC) or alternating current (AC), low voltage or line voltage. In one embodiment, the power transferred is line voltage AC.

In other embodiments, the light fixture may not be cylindrical along its entire length. For example, the main body 501 may have one or more portions that are generally cylindrical, where the mounting rings 304 engage the light fixture, but other portions of the light fixture may have cross sectional shapes other than round.

Figure 6:
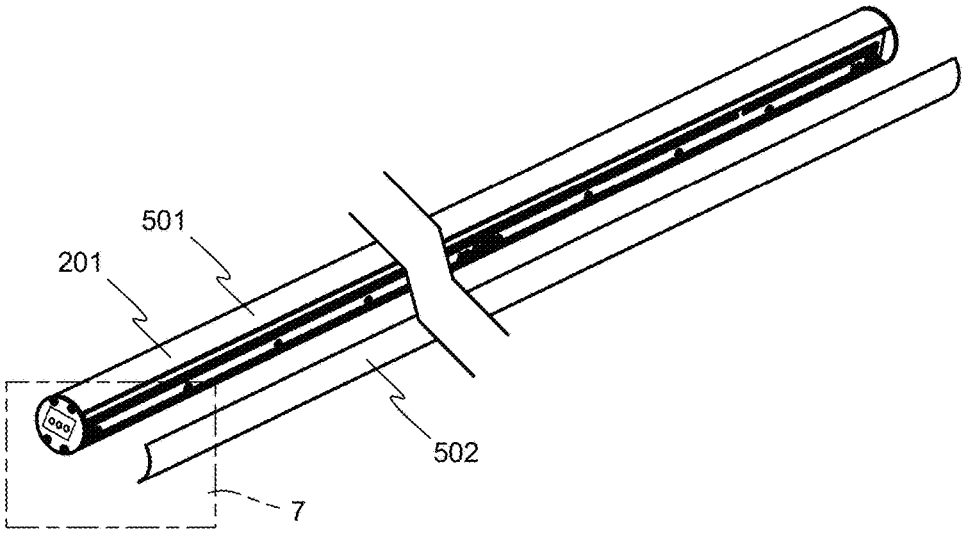
FIG. 6 illustrates a shortened and partially exploded view of the light fixture of FIG. 2.
Figure 7:
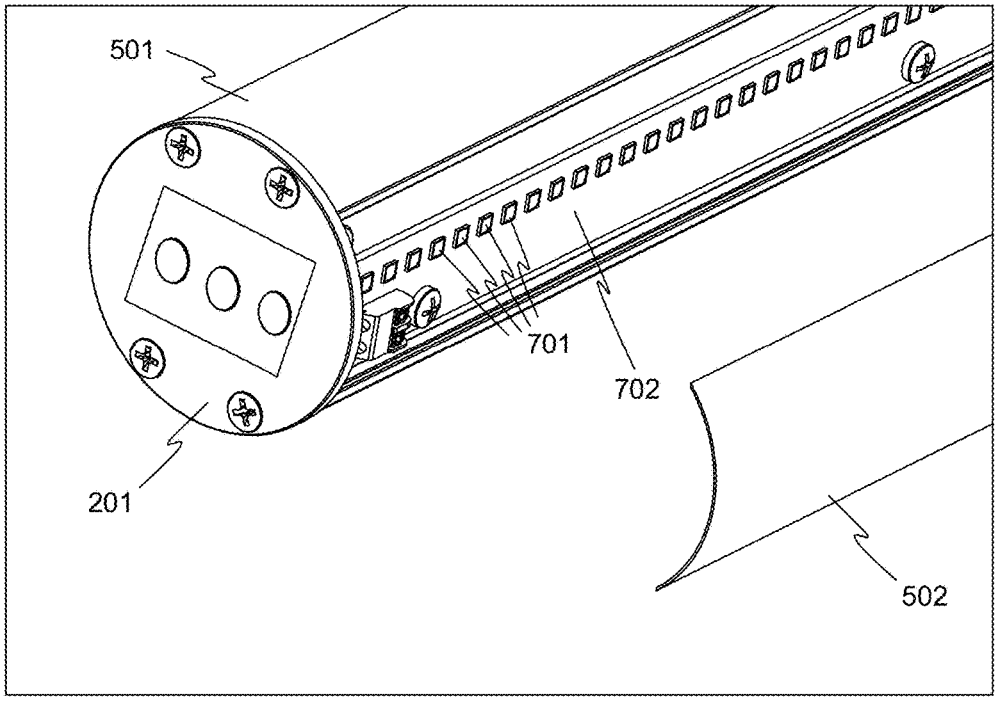
FIG. 7 is an enlarged view of a portion of FIG. 6.

FIG. 6 illustrates a shortened and partially exploded view of the light fixture 201. The diffuser 502 has been moved away from the rest of the light fixture 201 in FIG. 6. FIG. 7 illustrates a magnified view of a portion of FIG. 6, showing some internal details of the light fixture 201. As is visible in FIG. 7, a number of light emitting diodes (LEDs) 701 are positioned on one or more printed circuit boards 702, and face the diffuser 502. The LEDs are the light sources in this embodiment. In other embodiments, other kinds of light sources may be used.

Figure 8:
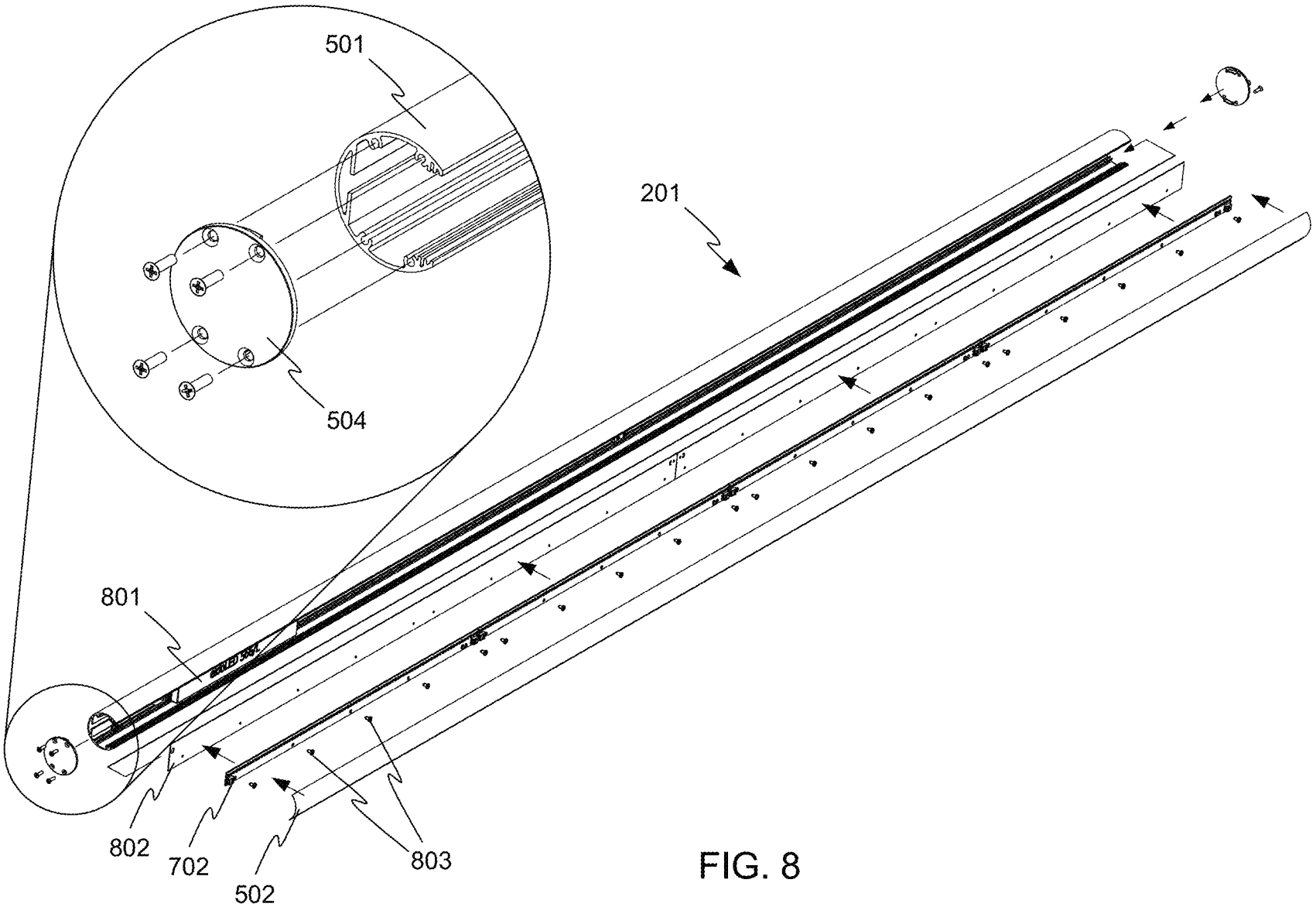
FIG. 8 shows a more completely exploded view of the light fixture of FIG. 2.

FIG. 8 shows a more completely exploded view of the light fixture 201, revealing additional details. The main body 501 may conveniently be made of extruded aluminum, with integral features for mounting other parts of the light fixture 201. However, in other embodiments, other materials and fabrication process may be used. The main body 501 may be a single monolithic piece, or made of multiple pieces joined together. In one embodiment, the main body 501 is generally cylindrical with an outer diameter of about two inches, but other shapes and sizes may be used as well. The light fixture 201 may be of any workable length, for example 12, 24, 36, 48, 60, 84, or 96 inches, or another length. In one embodiment, the light fixture 201 may be about 90 inches long. When the main body 501 is made of an extrusion, fixtures of different lengths may be made by cutting the extruded material to appropriate lengths and inserting the appropriate number and size of printed circuit boards and LEDs.

A driver circuit 801 is disposed within the main body 501, and in this embodiment converts line voltage AC power to the DC power required by the LEDs 701. (Wiring connections are omitted from the figures for clarity, but are understood to be present.) In some embodiments, the main body 501 may serve as a heat sink for the driver circuit 801.

The printed circuit boards 702 holding the LEDs 701 are mounted to one or more circuit board mounting substrates 802, and the diffuser 502 is placed over the other components. In the embodiment shown, the printed circuit boards 702 are attached to a printed circuit board mounting substrate 802 using a number of screws 803. The printed circuit board mounting substrates may be slid into the main body 501 from one end. The diffuser 502 may preferably snap into the open side of the main body 501, or may be slid into the main body 501 from one end. In other embodiments, components may be inserted into the main body 501 from the front, or a combination of assembly techniques may be used.

Figure 9:
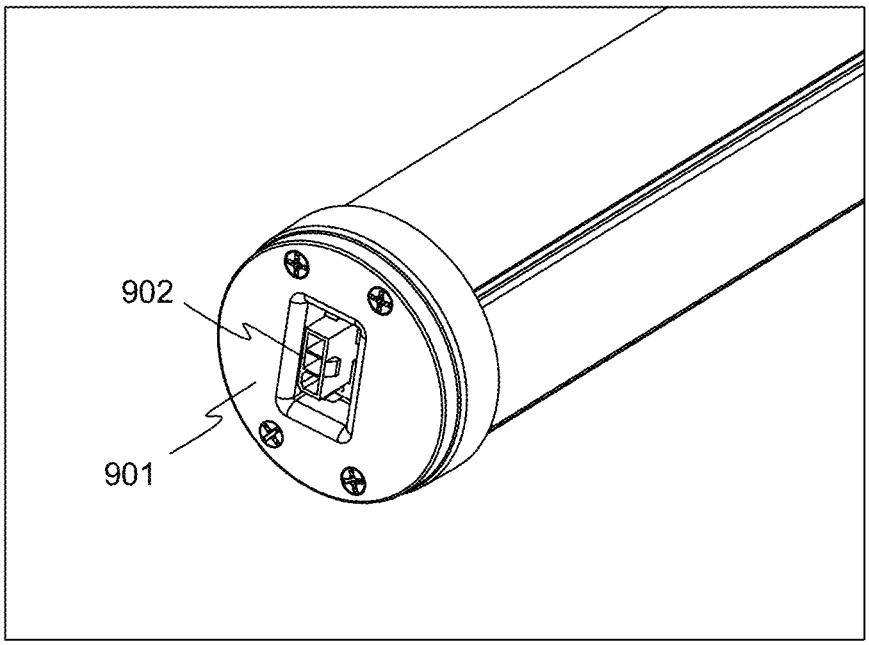
FIG. 9 illustrates an end cap and connector in accordance with other embodiments.

FIG. 9 illustrates an end cap 901 and connector 902 in accordance with other embodiments. The end cap 901 may be cup-shaped, and extend partly around the main body 501 and the diffuser 502.

Figure 10:
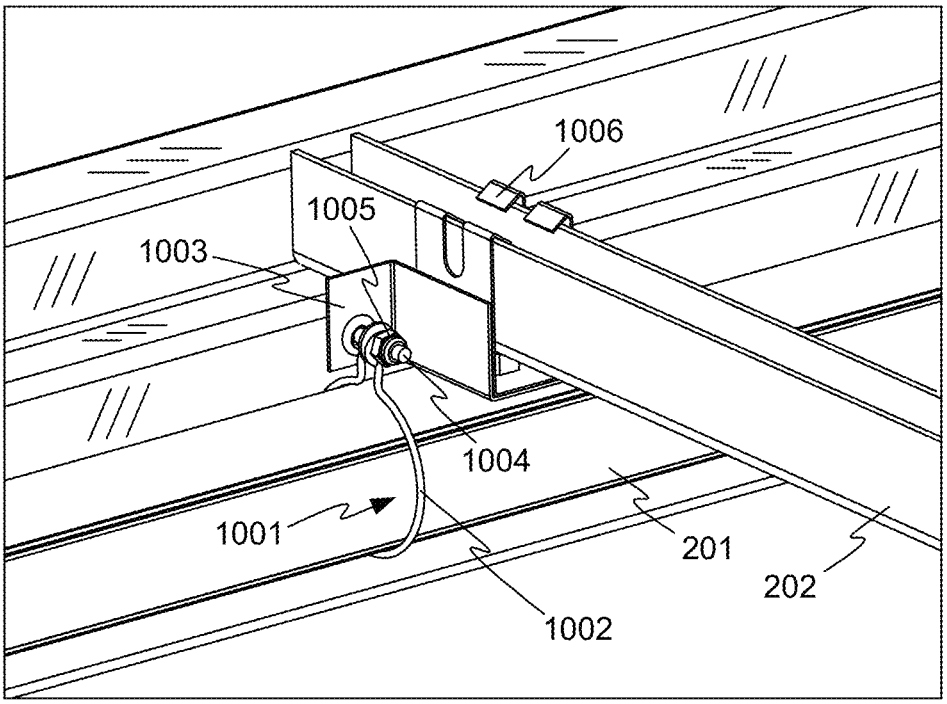
FIG. 10 and FIG. 11 illustrate upper and lower views respectively of a mounting ring in accordance with other embodiments.
Figure 11:
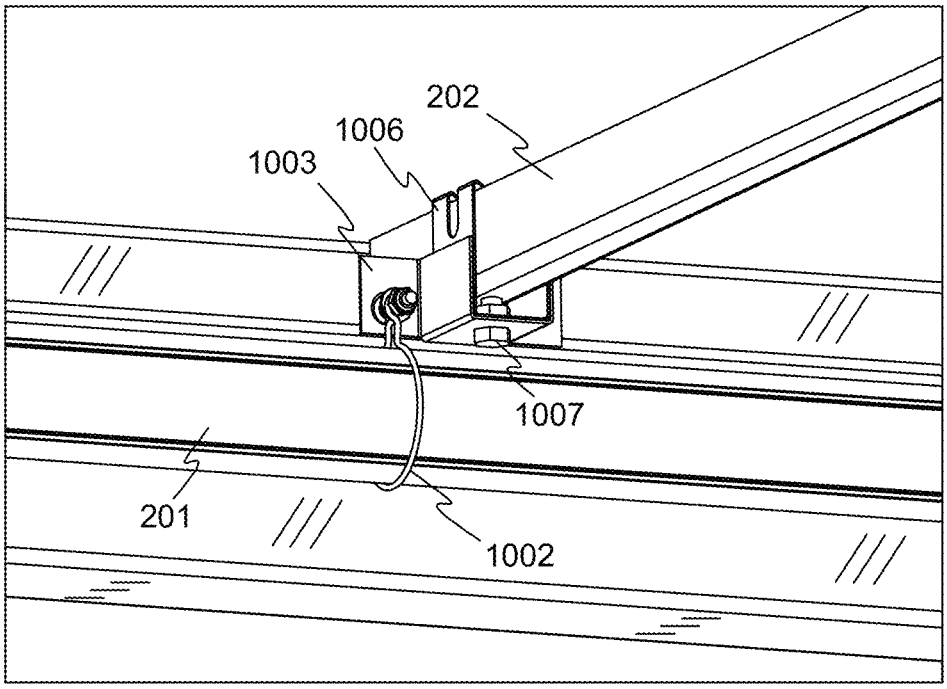

FIG. 10 and FIG. 11 illustrate upper and lower views respectively of a mounting ring 1001 in accordance with other embodiments. In this example, the mounting ring 1001 comprises a formed wire loop 1002 that encircles the light fixture 201. The wire loop 1002 is secured to a bracket 1003 by a bolt 1004 and nut 1005, although any other suitable attachment technique may be used. The bracket 1003 may be attached to a clip 1006 (similar to the clip 301 described above) and ultimately to the beam 202 by another bolt 1007 or another suitable technique.

Figure 12:
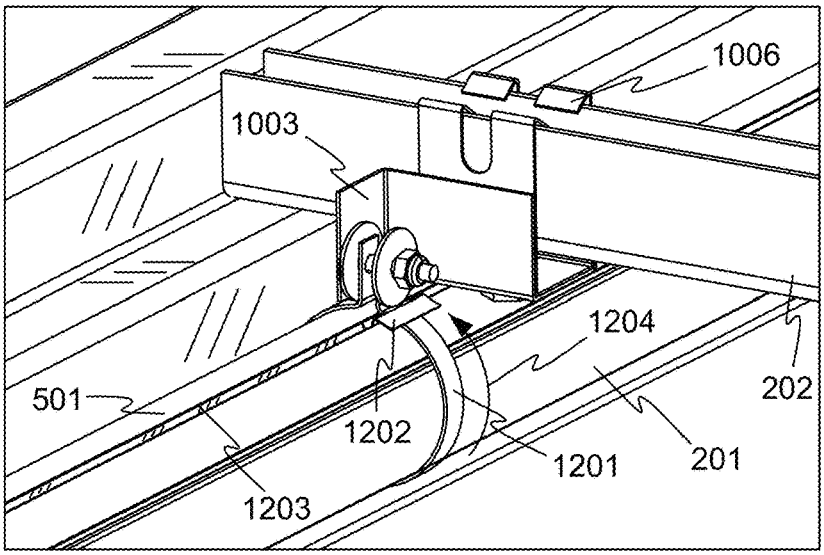
FIG. 12 shows an upper view of a mounting ring and a rotation stop in accordance with other embodiments.

FIG. 12 illustrates an upper view of a mounting ring 1201 in accordance with other embodiments. In this example, the mounting ring 1201 comprises a formed sheet metal ring, and is attached to the bracket 1003, the clip 1006, and the beam 202 in a manner similar to the embodiment of FIGS. 10 and 11. In addition, a rotation stop 1202 may be provided.

Figure 13:
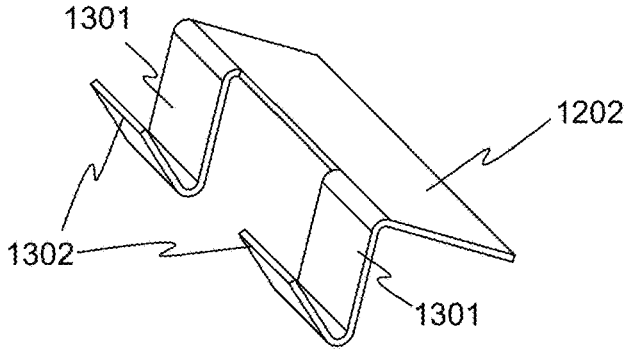
FIG. 13 shows the rotation stop of FIG. 12 in isolation.

The rotation stop 1202 is shown in isolation in FIG. 13. The rotation stop 1202 includes folded prongs 1301 that can be forced into a groove 1203 (visible in FIG. 12) in the main body 501 of the light fixture 201. Edges 1302 of the rotation stop 1202 may dig into the sides of the groove 1203, making the rotation stop 1202 very difficult to dislodge or remove. The rotation stop moves with the light fixture 201 during any rotation, and prevents rotation in direction 1204 beyond the point where the rotation stop 1202 encounters the upturned portion of the mounting ring 1201. Thus, the light fixture 201 is prevented from being placed in at least some ineffective orientations. The rotation stop 1202 may preferably be made of steel or a similar material, so that it can securely dig into the material of the main body 501 of the light fixture 201, which may be made of aluminum, a polymer, or another similar material.

Figure 14:
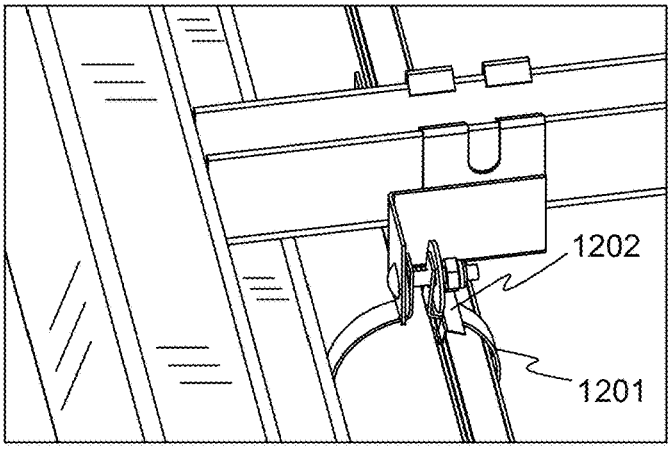
FIG. 14 shows another upper view of the mounting ring and the rotation stop of FIG. 12.

FIG. 14 shows another upper view of the mounting ring 1201 and the rotation stop 1202.

Figure 15:
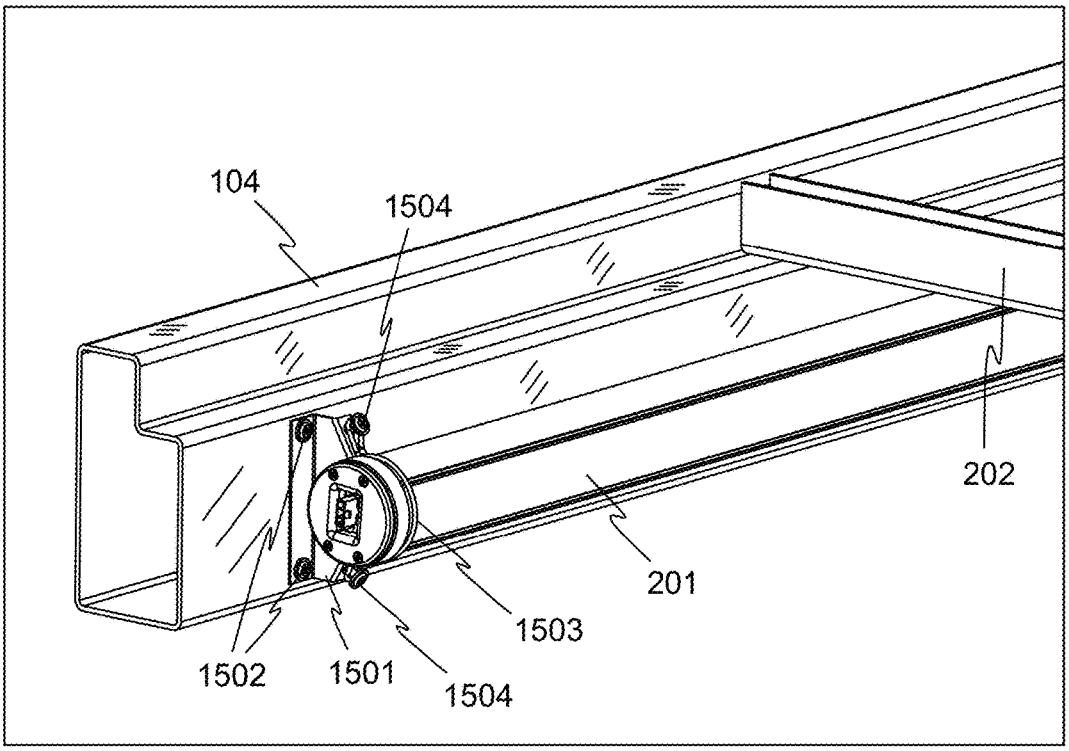
FIG. 15 illustrates the mounting of a light fixture in a merchandise bay, in accordance with other embodiments of the invention.

FIG. 15 illustrates the mounting of a light fixture such as the light fixture 201 in a merchandise bay such as the bay 100, in accordance with other embodiments of the invention. In this embodiment, the light fixture 201 mounts directly to a flat surface of the front crossbeam 104 of the bay 100, rather than hanging from the front-to-back beams 202. An angle bracket 1501 mounts to the front crossbeam 104, using screws or bolts 1502, or by another suitable method. The light fixture 201 is held against the angle bracket 1501 by a spring clip 1503, which is in turn connected to the angle bracket 1501 by screws or bolts 1504, or by another suitable method. While only one end of the light fixture 201 and the front crossbeam 104 are shown in FIG. 15, a similar arrangement mounts the other end of the light fixture 201 to the other end of the front crossbeam 104.

Figure 16:
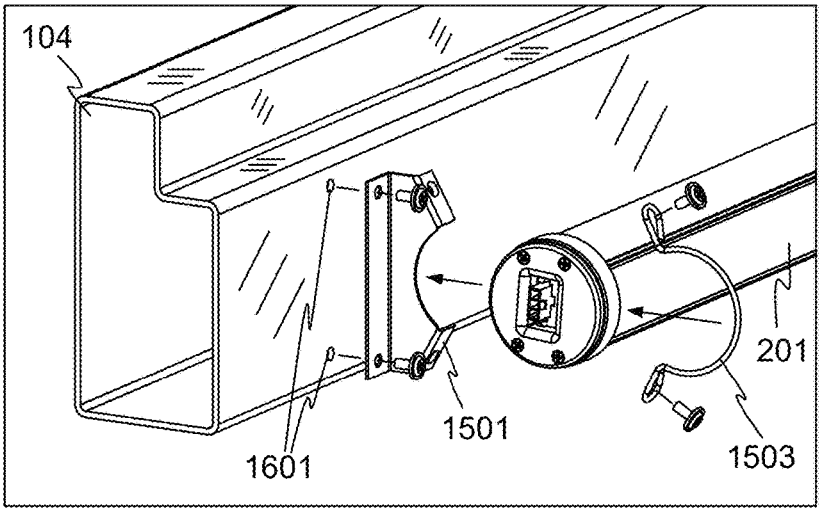
FIG. 16 shows an exploded view of the mounting arrangement of FIG. 15.

FIG. 16 shows an exploded view of the mounting arrangement of FIG. 15. The angle bracket 1501 may bolt to the front crossbeam 104 through holes 1601. For example, the holes 1601 may be threaded and the screws or bolts 1502 may be machine screws. In other embodiments, the screws or bolts 1502 may be sheet metal or self-tapping screws and the holes 1601 may be simple through holes sized to compatibly receive the screws or bolts 1502.

Figure 17:
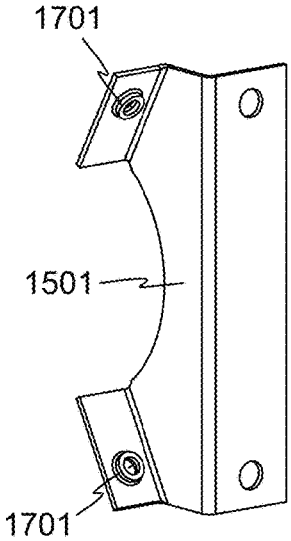
FIG. 17 shows a reverse angle enlarged view of the angle bracket of FIG. 15.

FIG. 17 shows a reverse angle enlarged view of the angle bracket 1501. In this example embodiment, the angle bracket 1501 includes extruded holes 1701, which may be tapped for convenient acceptance of machine screws, or may be smooth-sided for use with sheet metal or self-tapping screws.

In other embodiments, different materials and parts may be used to achieve a mounting arrangement similar to that or FIG. 15. For example, while the angle bracket 1501 is illustrated as a stamped sheet metal part, likely made from steel or aluminum, the angle bracket 1501 in other embodiments may be a molded plastic part made from a suitable polymer such as ABS, polycarbonate, or another polymer or combination of polymers. In other embodiments, the angle bracket 1501 may be die cast from zinc, aluminum, or another suitable metal or alloy. Many variations are possible.

Figure 18:
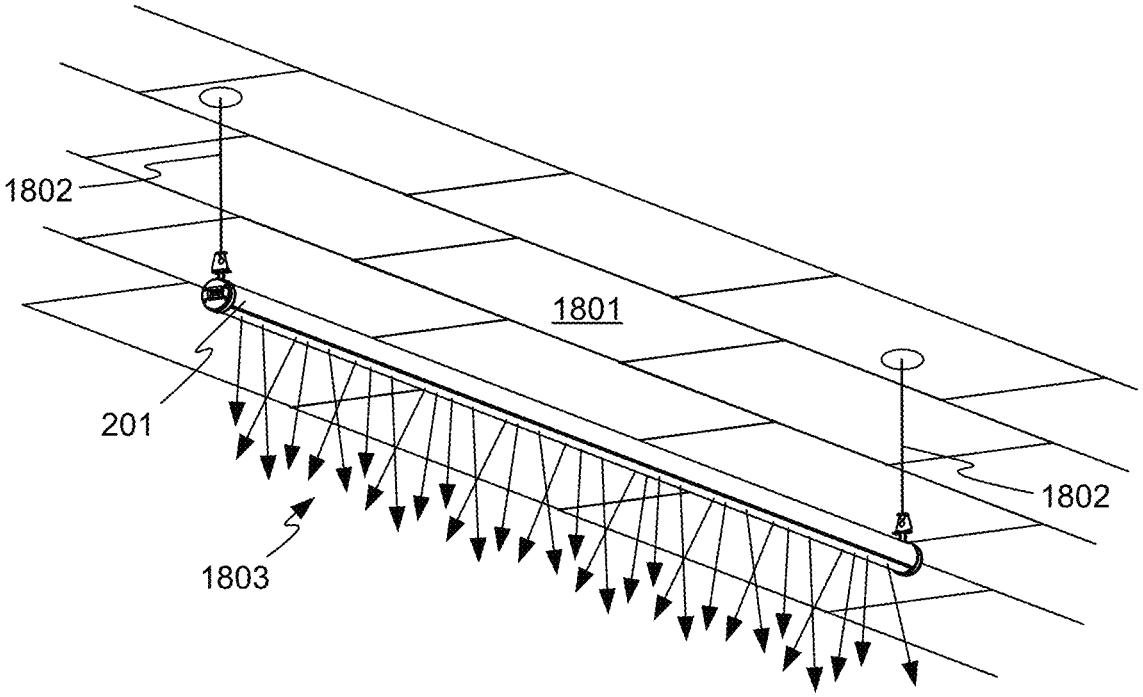
FIG. 18 illustrates the use of the light fixture of FIG. 2 in a suspension mount, in accordance with embodiments of the invention.

While embodiments have been described above in the context of a merchandise bay, a light fixture such as the light fixture 201 may be used in other locations and contexts as well. For example, FIG. 18 illustrates the use of the light fixture 201 in a suspension mount, below a ceiling 1801, in accordance with embodiments of the invention. The light fixture 201 is hung from the ceiling 1801 using light cables 1802, although chains, brackets, or other mountings may be used. In FIG. 18, the light fixture 201 is pointed downward into a room below, so that light 1803 falls symmetrically below the light fixture 201. However, in other embodiments, the light fixture 201 may be rotated so that the light 1803 is directed more to one side of the light fixture 201 than to the other side. In other embodiments, the light fixture 201 may be pointed upward, so that the room is lit indirectly by light reflecting from the ceiling 1801.

Multiple light fixture 201 may be used, and each may receive power individually through a cord descending from the ceiling 1801. In other embodiments, multiple suspended light fixtures 201 may be daisy-chained together, so that some of the fixtures receive their power from adjacent like fixtures.

Figure 19:
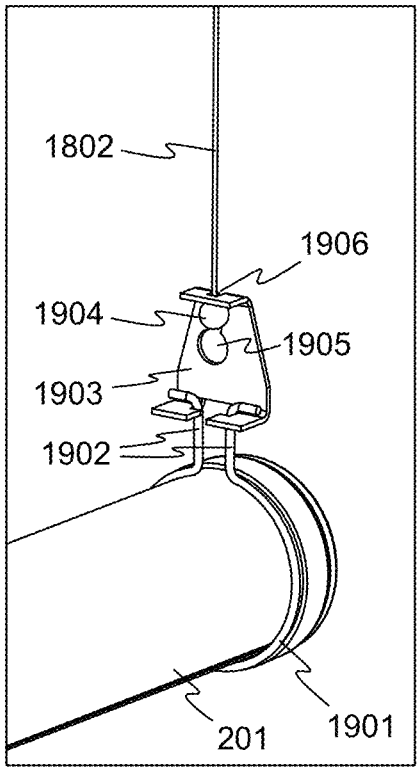
FIG. 19 and FIG. 20 illustrate one way to connect the light fixture of FIG. 2 to the cables of FIG. 18, in accordance with embodiments of the invention.
Figure 20:
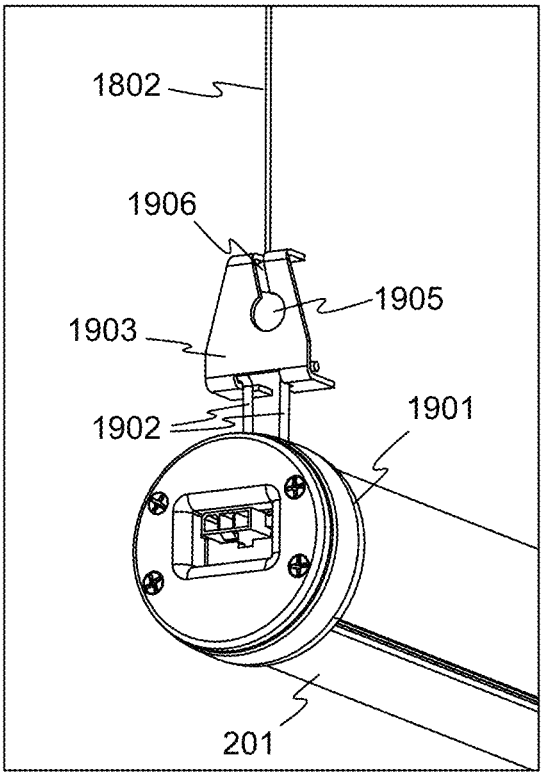

FIG. 19 and FIG. 20 illustrate one way to connect the light fixture 201 to the cables 1802, in accordance with embodiments of the invention. A wire spring clip 1901 substantially encircles the light fixture 201. The wire spring clip 1901 has hooked ends 1902 that clip into a hanger 1903. The cable 1802 includes a bulbous end 1904, which may be crimped, soldered, or otherwise fixed to the cable 1802. The bulbous end 1904 fits through an opening 1905 in the hanger 1903, and is constrained by narrow slot 1906 from slipping out of the hanger 1903.

The hanger 1903 may be removed from the cable 1802 by lifting the light fixture 201 and slipping the bulbous end 1904 out of the hanger 1903 through the opening 1905. The wire spring clip 1901 may be removed by pinching its hooked ends 1902 together and slipping them out of the hanger 1903.

Preferably, the wire spring clip 1901 and the hanger 1903 are sized such that when the hooked ends 1902 of the wire spring clip 1901 are clipped into the hanger 1903, the hooked ends 1902 are under spring tension, resulting in the wire spring clip 1901 gripping the light fixture 201. Thus, the light fixture 201 is held in its rotational orientation. Because the light fixture 201 is round, it may be positioned in any desired rotational orientation, either by releasing the wire spring clip 1901, positioning the light fixture 201 as desired, and re-attaching the wire spring clip 1901, or by simply rotating the light fixture 201 against the friction of the wire spring clip 1901 while the wire spring clip 1901 is in place.

Many variations are possible within this basic arrangement. For example, the wire spring clip 1901 may be replaced by a spring clip made from a ribbon of metal. And while the hanger 1903 is shown as a stamped metal part, it could be made in any other suitable way and from any suitable material. In another embodiment, the spring clip and the hanger may be combined into a single part that supports the light fixture 201 and attaches directly to the cable 1802. In other embodiments, any other workable arrangement for suspending the light fixture 201 may be used.

Figure 21:
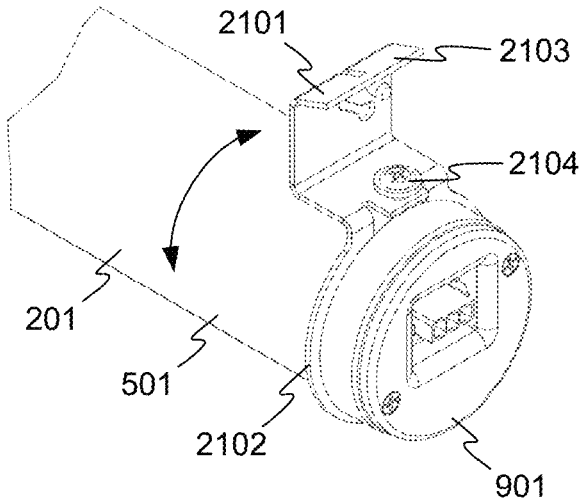
FIG. 21 illustrates another technique for suspending a light fixture such as the light fixture 201, in accordance with other embodiments of the invention.

FIG. 21 illustrates another technique for suspending a light fixture such as the light fixture 201, in accordance with other embodiments of the invention. A stamped holder 2101 includes a mounting ring 2102 that encircles or substantially encircles the main body 501 of the light fixture 201, behind the cap 901. The holder 2101 also includes a slotted tang 2103 for attaching a cable, as is described in more detail below. A locking screw 2104 may be provided, for contacting the main body 501 and locking the light fixture 201 in a specific rotational orientation within the holder 2101.

Figure 22A:
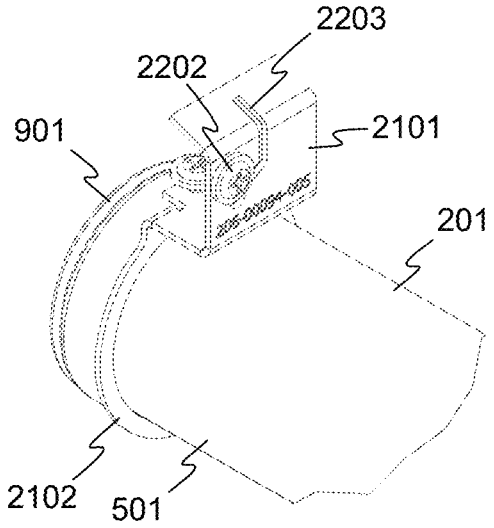
FIGS. 22A-22C illustrate attaching a holder to a suspension cable in the technique of FIG. 21.
Figure 22B:
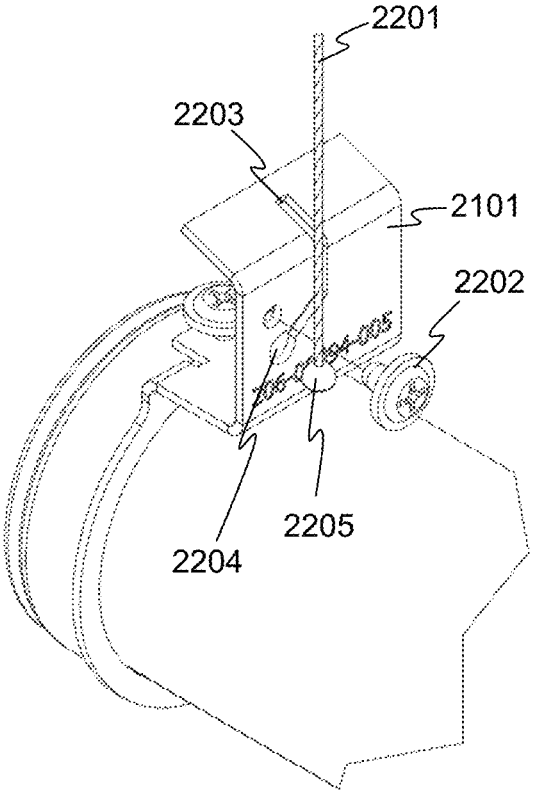
Figure 22C:
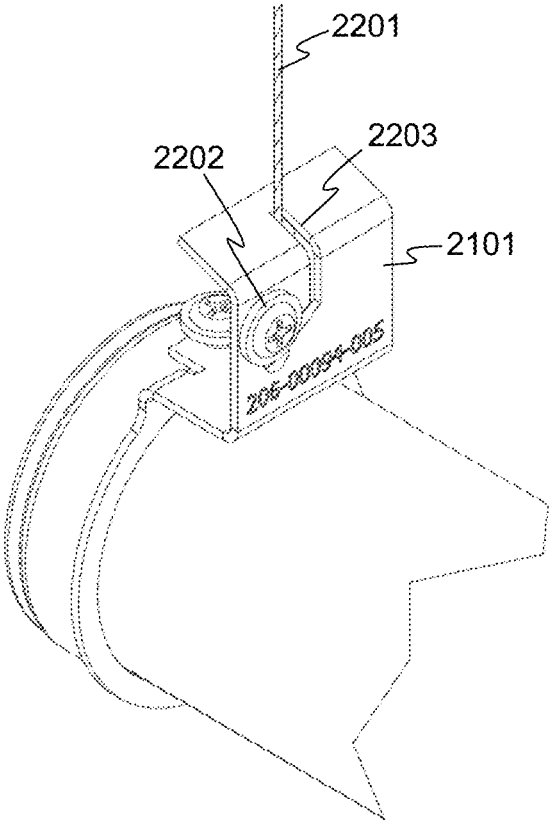

FIGS. 22A-22C illustrate attaching the holder 2101 to a suspension cable 2201. A clamping screw 2202 is first loosened or removed, to provide access to a slot 2203 and an enlarged opening 2204 in the slotted tang 2103. A bulbous end 2205 or other enlarged feature of the cable 2201 is passed through the enlarged opening 2204, and the cable 2201 is passed into the slot 2203. Once the cable is in place, the clamping screw 2202 is tightened to cover the enlarged opening 2204, preventing the cable 2201 from inadvertently disconnecting from the holder 2101.

Figure 23:
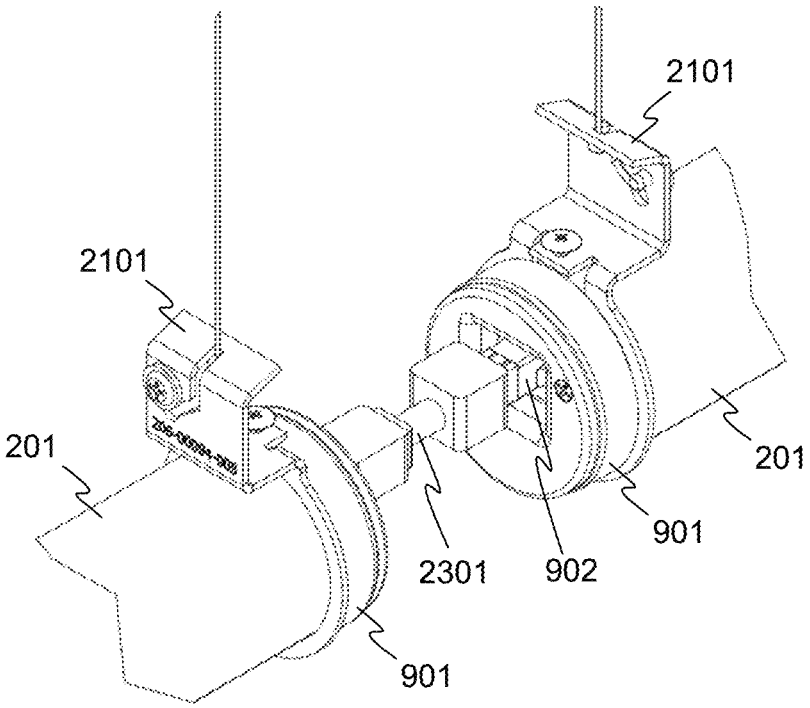
FIG. 23 illustrates the connection of two adjacent similar light fixtures in "daisy chain" fashion, in accordance with embodiments of the invention.

FIG. 23 illustrates the connection of two adjacent similar light fixtures 201 in "daisy chain" fashion, using a connecting cable 2301 compatible with the connectors 902 of the light fixtures 201, in accordance with embodiments of the invention. In some embodiments, the connectors on the two ends of any one light fixture 201 are not identical, so that each light fixture 201 has an input end and an output end, and the light fixtures 201 must be arranged with their respective compatible ends adjacent.

Figure 24:
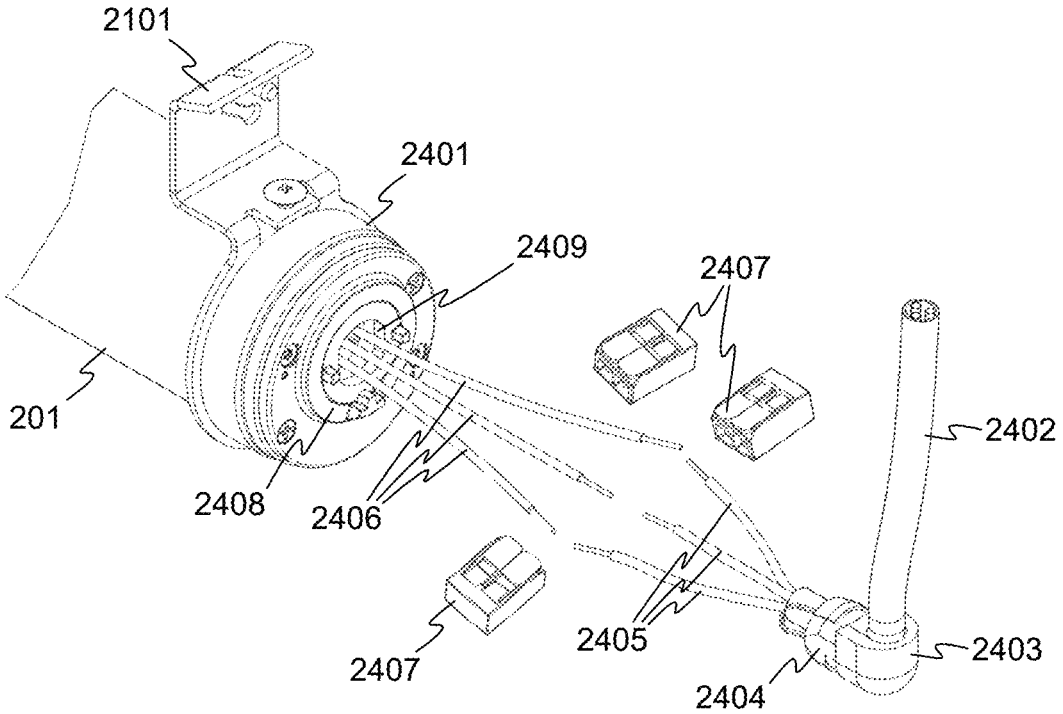
FIG. 24 illustrates a special end cap, in accordance with embodiments of the invention.

FIG. 24 illustrates a special end cap 2401 usable to connect a power supply cable 2402 to the light fixture 201, in accordance with embodiments of the invention. The power supply cable 2402 may, for example, descend from a ceiling below which the light fixture 201 is being suspended. The power supply cable 2402 includes a right angle fitting 2403, having a pair of flat sides 2404 (only one of which is visible in FIG. 24). The conductors 2405 from the power supply cable 2402 may be connected to corresponding conductors 2406 of the light fixture 201, using connectors 2407. The end cap 2401 may be used on the first fixture in a row of daisy-chained fixtures, to make the initial connection to mains or other power.

The cap 2401 has a rotatable insert 2408, having an opening complementary to part of the perimeter shape of the right angle fitting 2403, including flat faces 2409 complementary to the flat sides 2404 of the right angle fitting 2403.

Figure 25:
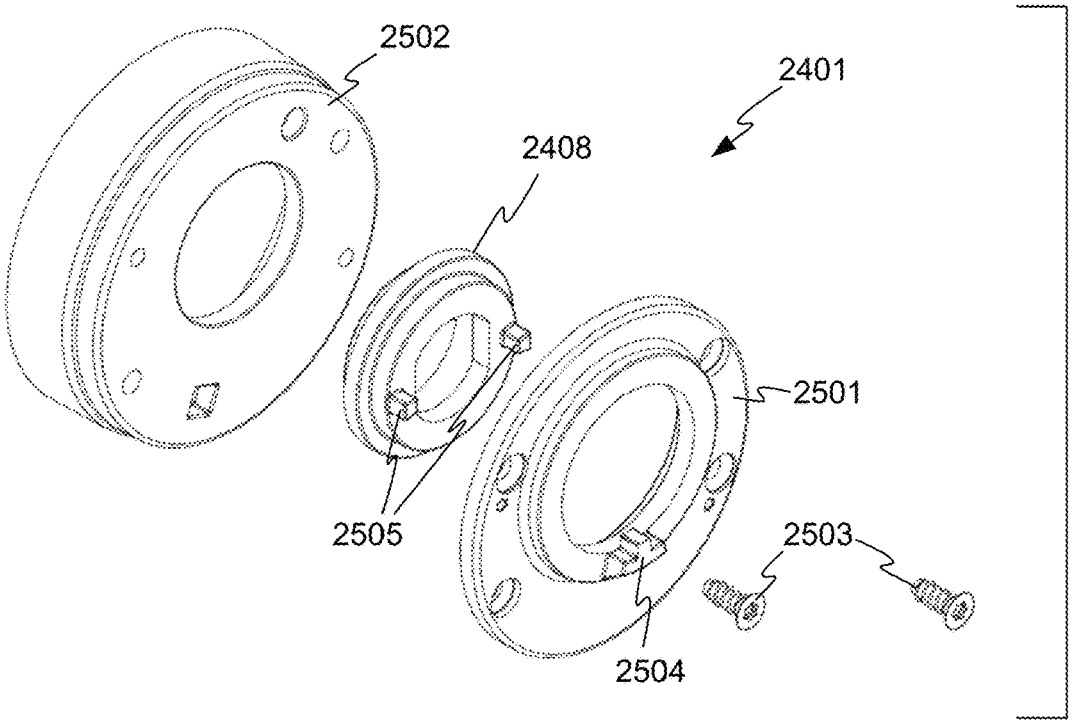
FIG. 25 shows an exploded view of the end cap of FIG. 24.
Figure 26:
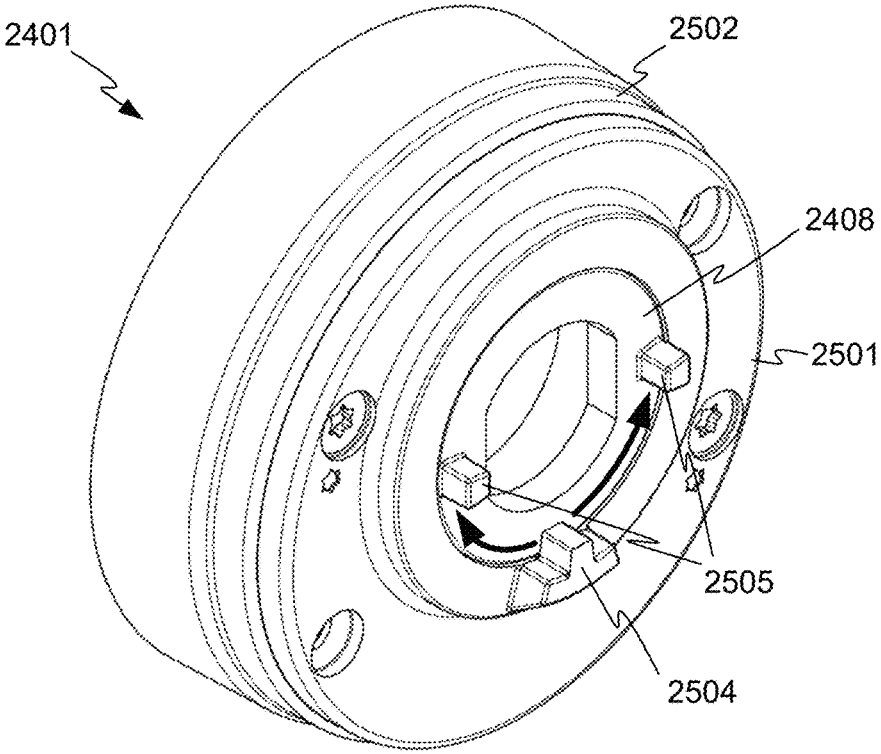
FIG. 26 shows an assembled view of the end cap of FIG. 24.

FIG. 25 shows an exploded view of the end cap 2401, and FIG. 26 shows an assembled view of the end cap 2401. An end plate 2501 captures the rotatable insert 2408 between the end plate 2501 and a cup 2502 once screws 2503 are tightened into the main body of the light fixture 201 (not shown in FIG. 25). The rotatable insert 2408 fits loosely between the end plate 2501 and the cup 2502, so that the rotatable insert 2408 and the rest of the end cap 2401 can freely rotate with respect to each other.

However, the amount of rotation may be limited. In the example of FIGS. 25 and 26, the end plate 2501 includes a protrusion 2504, and the rotatable insert 2408 includes two rotation stops 2505. As is shown in FIG. 26, the end plate 2501 and the cup 2502 (and thus the light fixture 201) can rotate only until the protrusion 2504 reaches the rotation stops 2505.

Figure 27:
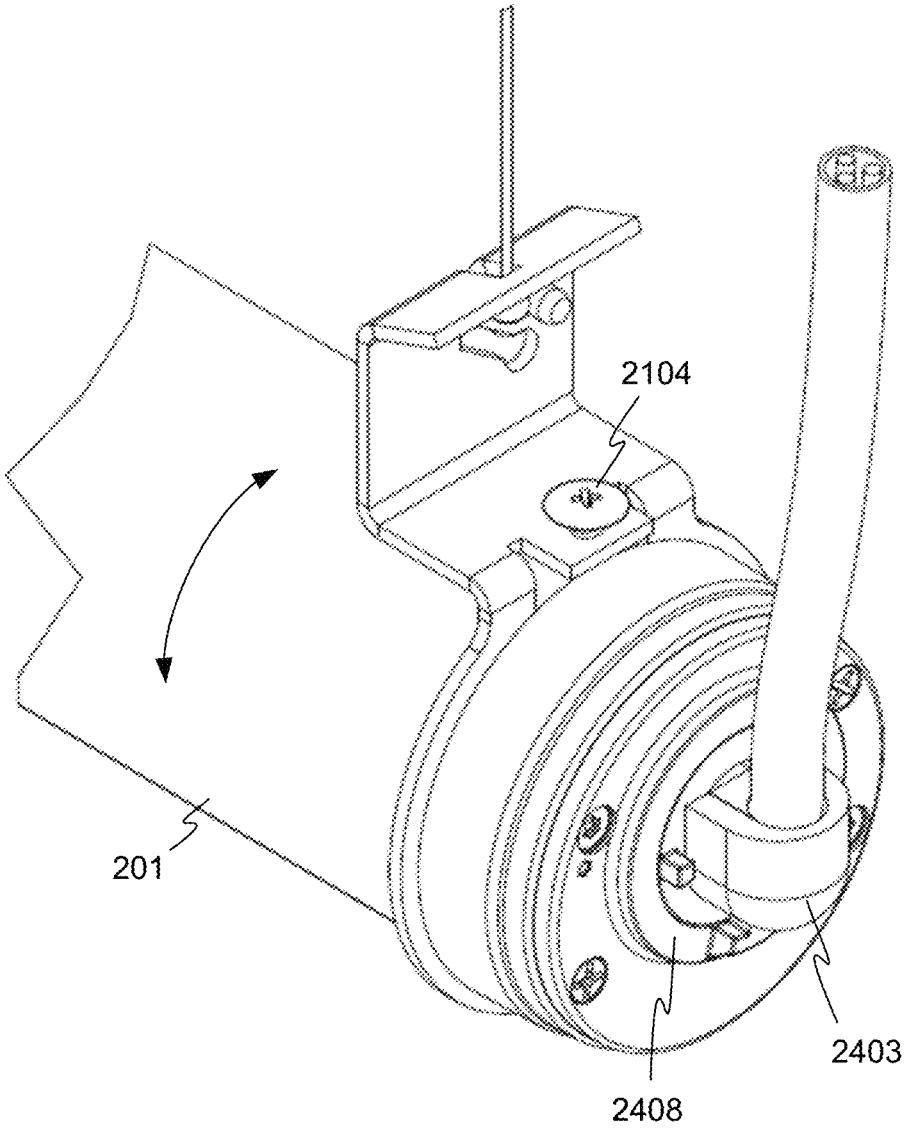
FIG. 27 shows the completed end cap assembly, in accordance with embodiments of the invention.

FIG. 27 shows the completed end cap assembly, and illustrating that the rotatable insert 2408 is held substantially stationary by the right angle fitting 2403. In the version shown, the rotation of the light fixture is thus limited to about +/−90 degrees from the illustrated position. In other embodiments, the rotation stops 2505 may be placed in other locations, to provide for more or less rotation range. Once the light fixture 201 (other than the rotatable insert 2408) is in the desired rotational position, the locking screw 2104 can be tightened to fix the rotational position of the light fixture 201.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture, comprising:

a main body, at least a portion of the main body being generally cylindrical and having a diameter and a longitudinal axis and opposite ends spaced apart along the longitudinal axis, wherein the main body has a length along the longitudinal axis of at least six times the diameter, and wherein the main body has an open side extending longitudinally between the opposite ends of the main body;

one or more light sources disposed within the main body; and two or more mounting rings, a respective one of the two or more mounting rings positioned proximate each end of the main body, the mounting rings configured to substantially encircle the generally cylindrical portion of main body and configured for mounting the light fixture.

2. The light fixture of claim 1, wherein the main body is generally cylindrical along its entire length.

3. The light fixture of claim 1, further comprising a diffuser covering the open side of the main body and enclosing the one or more light sources within the light fixture.

4. The light fixture of claim 1, wherein the main body can be positioned at any angular orientation within the two or more mounting rings.

5. The light fixture of claim 1, further comprising a screw disposed through one of the mounting rings and tightenable against the main body to lock the main body at a specific rotation angle.

6. The light fixture of claim 1, wherein at least one of the two or more mounting rings forms a clamp tightenable against the main body to lock the main body at a specific rotation angle.

7. The light fixture of claim 1, wherein at least one of the two or more mounting rings maintains friction with the main body via spring tension.

8. The light fixture of claim 1, further comprising a driver circuit disposed within the main body.

9. The light fixture of claim 8, wherein the one or more light sources comprise a plurality of light emitting diodes (LEDs), and wherein the driver circuit converts alternating current (AC) line voltage to a direct current (DC) voltage for driving the LEDs.

10. The light fixture of claim 1, further comprising a respective connector at each end of the main body, the connectors configured to enable connecting additional like light fixtures in daisy chain fashion.

11. The light fixture of claim 1, wherein the mounting rings comprise formed wire loops.

12. The light fixture of claim 1, wherein the mounting rings comprise formed sheet metal loops.

13. The light fixture of claim 1, further comprising a rotation stop, wherein the rotation stop engages a groove in the main body.

14. The light fixture of claim 1, further comprising an angle bracket and a clip configured for mounting the light fixture to a flat surface.

15. The light fixture of claim 1, further comprising a hanger configured for suspending the light fixture from a ceiling.

16. The light fixture of claim 1, further comprising an end cap and a rotatable insert in the end cap, the rotatable insert including rotation stops that limit the range of rotation of the light fixture.

17. A merchandise bay, comprising:

a shelf;

a front crossbeam supporting a front edge of the shelf; and a light fixture mounted below the shelf and behind the front crossbeam, the light fixture further comprising:

a main body having an open side;

one or more light sources disposed within the main body; and one or more mounting rings configured to substantially encircle the main body and configured for mounting the light fixture.

18. The merchandise bay of claim 17, further comprising a diffuser covering the open side of the main body and enclosing the one or more light sources within the light fixture.

19. The merchandise bay of claim 17, wherein the main body of the light fixture comprises at least a portion that is generally cylindrical, and wherein the mounting rings substantially encircle the main body in the generally cylindrical portion.

20. The merchandise bay of claim 19, wherein the light fixture can be positioned at any angular orientation within the one or more mounting rings.

21. The merchandise bay of claim 17, wherein the shelf is a first shelf, the front crossbeam is a first front crossbeam, and the light fixture is a first light fixture, the merchandise bay further comprising:

a second shelf;

a second front crossbeam supporting a front edge of the second shelf; and a second light fixture substantially identical to the first light fixture, the second light fixture mounted below the second shelf and behind the second front crossbeam.

* * * * *